US007754316B2

(12) United States Patent
Littecke et al.

(10) Patent No.: US 7,754,316 B2
(45) **Date of Patent: *Jul. 13, 2010**

(54) COATED CUTTING TOOL INSERT

(75) Inventors: Peter Littecke, Huddinge (SE); Henrik Nordlund, Täby (SE); Jan Kjellgren, Kista (SE)

(73) Assignee: Sandvik Intellectual Property AB, Sandviken (SE)

( * ) Notice: Subject to any disclaimer, the term of this patent is extended or adjusted under 35 U.S.C. 154(b) by 149 days.

This patent is subject to a terminal disclaimer.

(21) Appl. No.: 11/907,753

(22) Filed: Oct. 17, 2007

(65) Prior Publication Data

US 2008/0107882 A1 May 8, 2008

(30) Foreign Application Priority Data

Oct. 18, 2006 (SE) ..... 0602194

(51) Int. Cl.
*B32B 9/00* (2006.01)

(52) U.S. Cl. ..... 428/216; 51/307; 51/309; 407/119; 428/336; 428/698; 428/699; 428/701; 428/702

(58) Field of Classification Search ..... 51/307, 51/309; 428/216, 336, 698, 699, 701, 702; 407/119

See application file for complete search history.

(56) References Cited

U.S. PATENT DOCUMENTS 4,497,874 A * 2/1985 Hale ..... 428/551
4,966,501 A * 10/1990 Nomura et al. ..... 407/119
5,487,625 A 1/1996 Ljungberg et al.
5,702,808 A 12/1997 Ljungberg
5,786,069 A * 7/1998 Ljungberg et al. ..... 428/698
5,851,687 A 12/1998 Ljungberg
5,861,210 A 1/1999 Lenander et al.
5,863,640 A * 1/1999 Ljungberg et al. ..... 428/701
5,945,207 A * 8/1999 Kutscher et al. ..... 428/336
6,015,614 A * 1/2000 Ruppi ..... 428/698
6,333,098 B1 * 12/2001 Olsson et al. ..... 51/309
6,333,100 B1 * 12/2001 Palmqvist et al. ..... 428/336
6,344,264 B1 * 2/2002 Lenander et al. ..... 428/216
6,554,548 B1 * 4/2003 Grab et al. ..... 407/119
6,884,496 B2 4/2005 Westphal et al.

(Continued)

FOREIGN PATENT DOCUMENTS

EP 0298729 1/1989

(Continued)

OTHER PUBLICATIONS

Ismail C. Noyan et al., Residual Stress: Measurement by diffraction and interpretation, New York: Springer-Verlag (1987) pp. 117-130.

*Primary Examiner*—Archene Turner
(74) *Attorney, Agent, or Firm*—Drinker Biddle & Reath LLP

(57) ABSTRACT

The present invention relates to a CVD-coated cutting tool insert with a $TiC_xN_y$ layer with a low tensile stress level of from about 50 to about 390 MPa and an $\alpha$-$Al_2O_3$ layer with a high surface smoothness with a mean Ra is equal to or less than about 0.12 μm as measured by AFM-technique. This is obtained by subjecting the coating to an intensive wet blasting operation.

14 Claims, 1 Drawing Sheet

U.S. PATENT DOCUMENTS

| | | | | |
|---|---|---|---|---|
| 7,090,914 | B2 * | 8/2006 | Yamagata et al. | 51/307 |
| 2006/0204757 | A1 * | 9/2006 | Ljungberg | 428/701 |
| 2007/0009763 | A1 * | 1/2007 | Littecke et al. | 428/698 |

FOREIGN PATENT DOCUMENTS

| | | |
|---|---|---|
| EP | 0603144 | 6/1994 |
| EP | 0736615 | 10/1996 |
| EP | 1306150 | 5/2003 |
| EP | 1734155 | 12/2006 |

* cited by examiner

COATED CUTTING TOOL INSERT

BACKGROUND OF THE INVENTION

The present invention relates to a high performance coated cutting tool insert particularly useful for turning of steel, like low alloyed steels, carbon steels and tough hardened steels under demanding conditions. The insert is based on WC, cubic carbides and a Co-binder phase with a cobalt enriched surface zone giving the cutting insert an excellent resistance to plastic deformation and a high toughness performance. Furthermore, the coating comprises a number of wear resistance layers which have been subjected to a surface post treatment giving the tool insert a surprisingly improved cutting performance.

The majority of today's cutting tools are based on a cemented carbide insert coated with several hard layers like TiC, $TiC_xN_y$, TiN, $TiC_xN_yO_z$ and $Al_2O_3$. The sequence and the thickness of the individual layers are carefully chosen to suit different cutting application areas and work-piece materials to be cut. The most frequently employed coating techniques are Chemical Vapor Deposition (CVD) and Physical Vapor Deposition (PVD). CVD-coated inserts in particular have a tremendous advantage in terms of flank and crater wear resistance over uncoated inserts.

The CVD technique is conducted at a rather high temperature range, from about 950 to about 1050° C. Due to this high deposition temperature and to a mismatch in the coefficients of thermal expansion between the deposited coating materials and the cemented carbide tool insert, CVD can lead to coatings with cooling cracks and high tensile stresses (sometimes up to 1000 MPa). Under some cutting conditions, the high tensile stresses can be a disadvantage as it may aid the cooling cracks to propagate further into the cemented carbide body and cause breakage of the cutting edge.

In the metal cutting industry there is a constant striving to increase the cutting condition envelope, i.e., the ability to withstand higher cutting speeds without sacrificing the ability to resist fracture or chipping during interrupted cutting at low speeds.

Important improvements in the application envelope have been achieved by combining inserts with a binder phase enriched surface zone and optimized thicker coatings.

However, with an increasing coating thickness, the positive effect on wear resistance is out balanced by an increasing negative effect in the form of an increased risk of coating delamination and reduced toughness making the cutting tool less reliable. This applies in particular to softer work piece materials such as low carbon steels and stainless steels and when the coating thickness exceeds from about 5 to about 10 μm. Further, thick coatings generally have a more uneven surface, a negative feature when cutting smearing materials like low carbon steels and stainless steel. A remedy can be to apply a post smoothing operation of the coating by brushing or by wet blasting as disclosed in several patents, e.g., EP 0 298 729, EP 1 306 150 and EP 0 736 615. In U.S. Pat. No. 5,861,210 the purpose has, e.g., been to achieve a smooth cutting edge and to expose the $Al_2O_3$ as the top layer on the rake face leaving the TiN on the clearance side to be used as a wear detection layer. A coating with high resistance to flaking is obtained.

Every post treatment technique that exposes a surface, e.g., a coating surface to a mechanical impact as, e.g., wet or dry blasting will have some influence on the surface finish and the stress state (σ) of the coating.

An intensive blasting impact may lower the tensile stresses in a CVD-coating, but often this will be at the expense of lost coating surface finish by the creation of ditches along the cooling cracks or can even lead to delamination of the coating.

A very intensive treatment may even lead to a big change in the stress state, e.g., from highly tensile to highly compressive as disclosed in U.S. Pat. No. 6,884,496, in which a dry blasting technique is used.

EP 1 734 155 discloses a CVD-coated cutting tool insert with a $TiC_xN_y$-layer with a low tensile stress level of from about 50 to about 390 MPa and an $\alpha$-$Al_2O_3$-layer with a high surface smoothness with a mean Ra≦0.12 μm as measured by AFM-technique. This is obtained by subjecting the coating to an intensive wet blasting operation.

OBJECTS AND SUMMARY OF THE INVENTION

It is an object of the present invention to provide CVD-coated tool inserts with improved toughness properties.

In accordance with the present invention there is provided a coated cutting tool insert of cemented carbide comprising a body of generally polygonal or round shape having at least one rake face and at least one clearance face, said insert having a composition of from about 8.5 to about 11.5 wt-% Co, from about 6 to about 10 wt-% cubic carbonitrides, balance WC, a CW-ratio in the range from about 0.77 to about 0.90, and a surface zone of a thickness of from about 10 to about 35 μm, depleted of cubic carbonitride phase, said insert being at least partly coated with a from about 10 to about 25 μm thick coating including at least one layer of $TiC_xN_y$, where $x \geqq 0$, $y \geqq 0$ and $x+y=1$, and an $\alpha$-$Al_2O_3$ layer being the outer layer at least on the rake face and on said at least one rake face, the $TiC_xN_y$ layer has a thickness of from about 5 to about 15 μm and a tensile stress level of from about 50 to about 390 MPa; the $\alpha$-$Al_2O_3$ layer has a thickness of from about 3 to about 12 μm and is the outermost layer with an XRD-diffraction intensity ratio I(012)/I(024) is greater than or equal to about 1.3 and with a mean Ra value MRa less than or equal to about 0.12 μm at least in the chip contact zone on the rake face, as measured on ten randomly selected areas 10×10 $\mu m^2$ by AFM-technique and on said clearance face, the $TiC_xN_y$ layer has a tensile stress in the range from about 500 to about 700 MPa; the $\alpha$-$Al_2O_3$ layer has an XRD-diffraction intensity ratio I(012)/I(024) less than about 1.5; or on said at least one rake face and said at least one clearance side, the $TiC_xN_y$ layer has a thickness of from about 5 to about 15 μm and a tensile stress level of from about 50 to about 390 MPa, the $\alpha$-$Al_2O_3$ layer has a thickness of from about 3 to about 12 μm, an XRD-diffraction intensity ratio I(012)/I(024) greater than or equal to about 1.3, and on the rake face is the outermost layer with a mean Ra value MRa less than or equal to about 0.12 μm at least in the chip contact zone on the rake face, as measured on ten randomly selected areas 10×10 $\mu m^2$ by AFM-technique and on that said clearance face, the top layer comprises a colored heat resistant paint or a colored PVD layer.

DETAILED DESCRIPTION OF THE PREFERRED EMBODIMENTS

Figure 1:
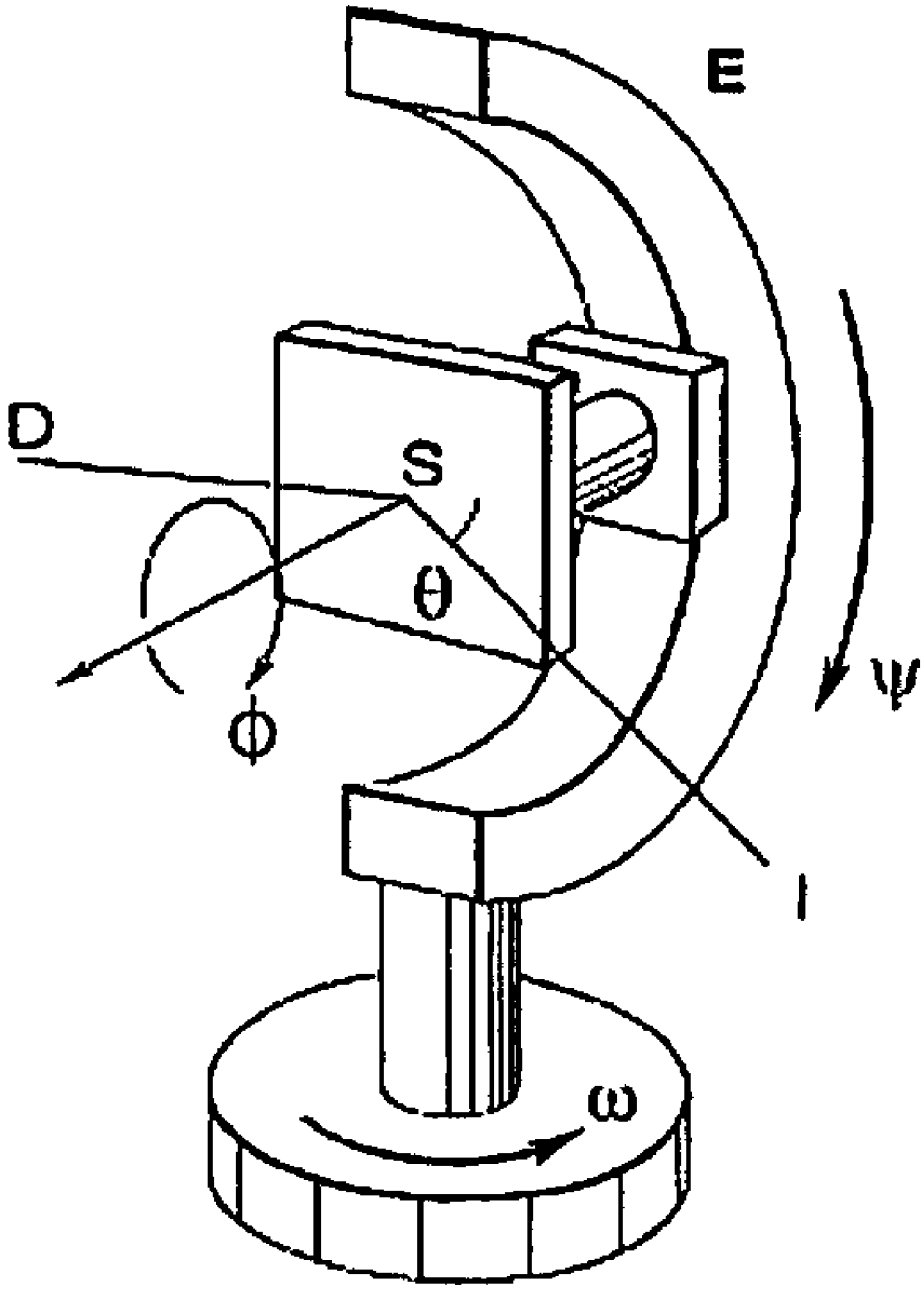
FIG. 1 is a representation of a goniometer setup which can be used to determine XRD measurements of a sample.

It has now been found that a cutting tool insert with surprisingly improved cutting performance particular in steel can be obtained if one combines a certain cemented carbide composition with a certain coating structure and thickness and then post treats the coated insert by wet-blasting under controlled tough conditions.

The cobalt binder phase is highly alloyed with W. The content of W in the binder phase can be expressed as the CW-ratio:

$$CW\text{-ratio}=\text{magnetic-\% Co}/\text{wt-\% Co}$$

where magnetic-% Co is the weight percentage of magnetic Co and wt-% Co is the weight percentage of Co in the cemented carbide.

The CW-ratio varies between 1 and about 0.75 dependent on the degree of alloying. A lower CW-ratio corresponds to higher W contents and CW-ratio=1 corresponds practically to an absence of W in the binder phase.

The employed post treatment will give the coating a favorable tensile stress level, the $Al_2O_3$ layer a certain important crystallographic feature and a top surface with an excellent surface finish.

The mentioned combination with the blasting technique effectively expands the limitations of what coating thickness that can be applied without performance penalty. As a result of the invention, application areas of unsurpassed width is now possible. The significant improvements achieved with respect to toughness behavior and coating adhesion was surprising.

To significantly change the stress state of a coating by blasting, the blasting media, e.g., $Al_2O_3$ grits have to strike the coating surface with a high impulse. The impact force can be controlled by, e.g., the blasting pulp pressure (wet blasting), the distance between blasting nozzle and coating surface, grain size of the blasting media, the concentration of the blasting media and the impact angle of the blasting jet.

The present invention thus relates to coated cutting tool inserts comprising a body of generally polygonal or round shape having at least one rake face and at least one clearance face comprising a coating and a cemented carbide. The body has a composition of from about 8.5 to about 11.5, preferably from about 9.3 to about 10.7, most preferably from about 9.3 to about 10.4, wt-% Co, from about 6 to about 10 wt-% cubic carbonitrides, balance WC, the body having a nitrogen content of from about 0.05 to about 0.15 wt-%, preferably from about 0.08 to about 0.12 wt-%, a CW-ratio between from about 0.77 to about 0.90, preferably from about 0.78 to about 0.88, most preferably from about 0.80 to about 0.84 and a surface zone of a thickness of from about 10 to about 35 μm, preferably from 15 to about 25 μm, depleted of cubic carbonitride phase. The cemented carbide may also contain small amounts, less than about 1 volume %, of eta phase ($M_6C$), without any detrimental effects. The coating comprises at least one $TiC_xN_y$ layer and one well-crystalline layer of 100% $\alpha$-$Al_2O_3$. One such $\alpha$-$Al_2O_3$ layer is the top visible layer on the rake face and along the cutting edge line and it can been intensively wet blasted with a sufficiently high energy to create tensile stress relaxation in both the $Al_2O_3$ and the $TiC_xN_y$ layers. The $Al_2O_3$ top layer has a very smooth surface at least in the chip contact zone on the rake face.

It has surprisingly been discovered that a significant improved toughness performance can be achieved if a coated cutting tool insert with a generally polygonal or round shape having at least one rake face and at least one clearance face said insert being at least partly coated produced to possess the following features:

a penultimate $TiC_xN_y$ layer with a thickness of from about 5 to about 15 μm, preferably from about 6 to about 13 μm, most preferably from about 7 to about 13 μm, where $x \geqq 0$, $y \geqq 0$ and $x+y=1$, preferably produced by MTCVD, with tensile stresses of from about 50 to about 390 MPa, preferably from about 50 to about 300 MPa, most preferably from about 50 to about 220 MPa and an outer $\alpha$-$Al_2O_3$ layer with a thickness of from about 3 to about 12 μm, preferably from about 3.5 to about 8 μm, most preferably from about 4 to about 8 μm, being the top layer on the rake face and along the edge line having a mean roughness Ra equal to or less than about 0.12 μm, preferably equal to or less than about 0.10 μm, at least in the chip contact zone of the rake face, measured over an area of 10 μm×10 μm by Atomic Force Microscopy (AFM) and an XRD-diffraction intensity (peak height minus background) ratio of I(012)/I(024) greater than or equal to about 1.3, preferably greater than or equal to about 1.5.

Preferably, there is a thin from about 0.2 to about 2 μm bonding layer of $TiC_xN_yO_z$, $x \geqq 0$, $z>0$ and $y \geqq 0$ between the $TiC_xN_y$ layer and the $\alpha$-$Al_2O_3$ layer. The total thickness of the coating is from about 10 to about 25 μm.

Additional layers can be incorporated into the coating structure between the substrate and the layers according to the present invention composed of metal nitrides and/or carbides and/or oxides with the metal elements selected from Ti, Nb, Hf, V, Ta, Mo, Zr, Cr, W and Al to a total coating thickness of <5 μm.

It is preferred to have some tensile stresses left in the $TiC_xN_y$ layer since it was found that if compressive stresses were to be induced by blasting, very high blasting impact force was required and under such conditions flaking of the coating frequently occurred along the cutting edge. It was also found that such induced compressive stresses were not as stable with respect to temperature increase, which occurs in a cutting operation as compared to if the coating has some tensile stresses still present.

The residual stress, $\sigma$, of the inner $TiC_xN_y$ layer is determined by XRD measurements using the well known $\sin^2\psi$ method as described by I. C. Noyan, J. B. Cohen, Residual Stress Measurement by Diffraction and Interpretation, Springer-Verlag, New York, 1987 (pp 117-130). The measurements are performed using $CuK_\alpha$-radiation on the $TiC_xN_y$ (422) reflection with a goniometer setup as shown in FIG. 1. The measurements are carried out on an as flat surface as possible. It is recommended to use the side-inclination technique ($\psi$-geometry) with six to eleven $\psi$-angles, equidistant within a $\sin^2\psi$-range of 0 to 0.5 ($\psi$=45°). An equidistant distribution of $\Phi$-angles within a $\Phi$-sector of 90° is also preferred. To confirm a biaxial stress state the sample shall be rotated for $\Phi$=0° and 90° while tilted in $\psi$. It is recommended to investigate possible presence of shear stresses and therefore both negative and positive $\psi$-angles shall be measured. In the case of an Euler ¼-cradle this is accomplished by measuring the sample also at $\Phi$=180° and 270° for the different $\psi$-angles. The $\sin^2\psi$ method is used to evaluate the residual stress preferably using some commercially available software such as DIFFRAC$^{Plus}$ Stress32 v. 1.04 from Bruker AXS with the constants Young's modulus, E=480 GPa and Poisson's ratio, $\nu$=0.20 in case of a MTCVD Ti(C,N) layer and locating the reflection using the Pseudo-Voigt-Fit function. In the case of the following parameters are used: E-modulus=480 GPa and Poisson's ratio $\nu$=0.20. In case of a biaxial stress state the tensile stress is calculated as the average of the obtained biaxial stresses.

For the $\alpha$-$Al_2O_3$ it is in general not possible to use the $\sin^2\psi$ technique since the required high 2θ angle XRD-reflections are often too weak. However, a useful alternative measure has been found which relates the state of the $\alpha$-$Al_2O_3$ to cutting performance.

For an $\alpha$-$Al_2O_3$ powder the diffraction intensity ratio I(012)/I(024) is close to 1.5. Powder Diffraction File JCPDS No 43-1484 states the intensities $I_0(012)=72$ and $I_0(024)=48$. For tensile stressed (with $\sigma$ about >350 MPa) CVD $\alpha$-$Al_2O_3$ layers on cemented carbide the intensity ratio I(012)/I(024) is surprisingly significantly less than the expected value 1.5, most often less than about 1. This may be due to some disorder in the crystal lattice caused by the tensile stresses. It has been found that when such a layer is stress released by, e.g., an intense blasting operation or if it has been completely removed from the substrate and powdered, the ratio I(012)/I(024) becomes closer, equal or even higher than 1.5 dependent. The higher the applied blasting force the higher the ratio will be. Thus, this intensity ratio can be used as an important state feature of an $\alpha$-$Al_2O_3$ layer.

According to the present invention, a cutting tool insert is provided with a CVD-coating comprising a penultimate $TiC_xN_y$ layer and an outer $\alpha$-$Al_2O_3$ layer. The $Al_2O_3$ can be produced according to U.S. Pat. No. 5,487,625 giving the $Al_2O_3$ layer a crystallographic texture in 012-direction with a texture coefficient TC(012) more than about 1.3, preferably more than about 1.5 or produced according to U.S. Pat. No. 5,851,687 and U.S. Pat. No. 5,702,808 giving a texture in the 110-direction with texture coefficient TC(110) more than about 1.5. In order to obtain a high surface smoothness and low tensile stress level, the coating is subjected to a wet blasting operation with a slurry consisting of F150 grits (FEPA-standard) of $Al_2O_3$ in water at an air pressure of from about 2.2 to about 2.6 bar from about 10 to about 20 sec/insert. The spray guns are placed approximately 100 mm from the inserts with a 90° spray angle. The insert has a different color on the clearance side than on the black rake face. An outermost thin from about 0.1 to about 2 μm coloring layer of TiN (yellow), $TiC_xN_y$ (grey or bronze), $ZrC_xN_y$ (reddish or bronze), where $x \geqq 0$, $y \geqq 0$ and $x+y=1$ or TiC (grey) is preferably deposited. The inserts are then blasted removing the top layer exposing the black $Al_2O_3$ layer. The coating on the rake face will have the low desired tensile stress from about 50 to about 390 MPa while the clearance side will have high tensile stresses in the range from about 500 to about 700 MPa dependent on the choice of coating and the coefficient of Thermal Expansion (CTE) of the used cemented carbide insert. In another embodiment of the invention the coated insert is blasted both on the rake face and the clearance side and a colored heat resistant paint is sprayed on the clearance side or a colored PVD layer is deposited there in order to obtain a possibility to identify a used cutting edge.

The invention is additionally illustrated in connection with the following examples, which are to be considered as illustrative of the present invention. It should be understood, however, that the invention is not limited to the specific details of the examples.

Example 1

A) Cemented carbide cutting inserts were manufactured by preparing a powder mixture with the composition 10.0 wt-% Co, 6.0 wt-% TaC, 2.1 wt-% TiC, 0.85 wt-% $TiC_{0.5}N_{0.5}$, balance WC, pressing and sintering in an inert atmosphere of 40 mbar Argon, at 1450° C. for 1 h. The resulting substrate had a surface zone (22 μm) depleted from cubic carbonitride phase. A CW-ratio of 0.82 was measured. The inserts were coated with a 0.5 μm thick layer of TiN using conventional CVD-technique at 930° C. followed by a 9 μm $TiC_xN_y$ layer employing the MTCVD-technique using $TiCl_4$, $H_2$, $N_2$ and $CH_3CN$ as process gases at a temperature of 885° C. In subsequent process steps during the same coating cycle a layer of $TiC_xO_z$ about 0.5 μm thick was deposited at 1000° C. using $TiCl_4$, CO and $H_2$, and then the $Al_2O_3$-process was started up by flushing the reactor with a mixture of 2% $CO_2$, 3.2% HCl and 94.8% $H_2$ for 2 min before a 7 μm thick layer of $\alpha$-$Al_2O_3$ was deposited. On top was a thin approximately 0.5 μm TiN layer deposited. The process conditions during the deposition steps were as below:

| | TiN | $TiC_xN_y$ | $TiC_xO_z$ | $Al_2O_3$-start | $Al_2O_3$ |
|---|---|---|---|---|---|
| Step | 1 and 6 | 2 | 3 | 4 | 5 |
| $TiCl_4$ | 1.5% | 1.4% | 2% | | |
| $N_2$ | 38% | 38% | | | |
| $CO_2$: | | | | 2% | 4% |
| CO | | | 6% | | |
| $AlCl_3$: | | | | | 3.2% |
| $H_2S$ | | | | | 0.3% |
| HCl | | | | 3.2% | 3.2% |
| $H_2$ | balance | balance | balance | balance | balance |
| $CH_3CN$ | — | 0.6% | | | |
| Pressure | 160 mbr | 60 mbr | 60 mbr | 60 mbr | 70 mbr |
| Temp.: | 930° C. | 885° C. | 1000° C. | 1000° C. | 1000° C. |
| Time | 30 min | 6 h | 20 min | 2 min | 7 h |

XRD-analysis of the deposited $Al_2O_3$ layer showed that it consisted only of the $\alpha$-phase with a texture coefficient TC(012)=1.4 defined as below:

$$TC(012) = \frac{I(012)}{I_o(012)}\left\{\frac{1}{n}\sum \frac{I(hkl)}{I_o(hkl)}\right\}^{-1}$$

where

I(hkl)=measured intensity of the (hkl) reflection $I_O$(hkl)=standard intensity of Powder Diffraction File JCPDS No 43-1484.

n=number of reflections used in the calculation (hkl) reflections used are: (012), (104), (110), (113), (024), (116).

Example 2

Coated inserts from Example 1 were post treated by the earlier mentioned blasting method. The rake face of the inserts were blasted, using a blasting pressure of 2.2 bar and an exposure time of 20 seconds.

The smoothness of the coating surface expressed as a well known roughness value Ra was measured by AFM on an equipment from Surface Imaging System AG (SIS). The roughness was measured on ten randomly selected plane surface areas (10 μm×10 μm) in the chip contact zone on rake face. The resulting mean value from these ten Ra values, MRa, was 0.10 μm.

X-ray Diffraction Analysis using a Bragg-Brentano diffractometer, Siemens D5000, was used to determine the I(012)/I(024)-ratio using Cu K$\alpha$-radiation.

The obtained I(012)/I(024)-ratio on the clearance side was about 1.4. Corresponding measurement for the rake face showed that the obtained I(012)/I(024)-ratio was about 1.7.

The residual stress was determined using $\psi$-geometry on an X-ray diffractometer Bruker D8 Discover-GADDS equipped with laser-video positioning, Euler ¼-cradle, rotating anode as X-ray source ($CuK_\alpha$-radiation) and an area detector (Hi-star). A collimator of size 0.5 mm was used to focus the beam. The analysis was performed on the $TiC_xN_y$ (422) reflection using the goniometer settings $2\theta=126°$, $\omega=63°$ and $\Phi=0°$, 90°, 180°, 270°, Eight $\psi$ tilts between 0° and 70° were performed for each Φ-angle. The $\sin^2\psi$ method was used to evaluate the residual stress using the software DIFFRAC$^{Plus}$ Stress32 v. 1.04 from Bruker AXS with the constants Young's modulus, E=480 GPa and Poisson's ratio, ν=0.20 and locating the reflection using the Pseudo-Voigt-Fit function. A biaxial stress state was confirmed and the average value was used as the residual stress value. Measurements were carried out both on the rake face and the clearance side. The obtained tensile stress on the clearance side was about 640 MPa. A corresponding measurement on the rake face showed that a tensile stress of about 280 MPa was obtained.

Example 3

Inserts produced according to Example 1 were tested against brushed inserts mentioned in Example 2 in cutting operations placing different types of demands on the tool.

TABLE 1

| Operation | Type of demand | Tool life Blasted | Tool life Brushed |
|---|---|---|---|
| Interrupted turning | Toughness | 1.2 | 1.0 |
| Longitudinal turning | Deformation resistance | 1.5 | 1.0 |
| Interrupted turning | Flaking resistance | No flaking at all | Flaking |

The results show that the blasted inserts have a better performance in all the aspects evaluated. Blasted inserts also have stress values significantly below those of the prior art, the highest I(012)/I(024) ratio of the $Al_2O_3$ layer and low mean Ra-values. These facts show that there exists a certain parameter space of properties which is directly related to the lifetime of cutting tool insert. Consequently a number of conditions and features have to be present simultaneously in order to achieve the high performance of the cutting tool insert.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A coated cutting tool insert of cemented carbide comprising a body of generally polygonal or round shape having at least one rake face and at least one clearance face, said insert having a composition of from about 8.5 to about 11.5 wt-% Co, from about 6 to about 10 wt-% cubic carbonitrides, balance WC, a CW-ratio in the range from about 0.77 to about 0.90, and a surface zone of a thickness of from about 11 to about 35 μm, depleted of cubic carbonitride phase, said insert being at least partly coated with a from about 10 to about 25 μm thick coating including at least one layer of $TiC_xN_y$, where x≧0, y≧0 and x+y=1, and an α-$Al_2O_3$ layer being the outer layer at least on the rake face and on said at least one rake face;

the $TiC_xN_y$ layer has a thickness of from about 5 to about 15 μm and a tensile stress level of from about 50 to about 390 MPa;

the α-$Al_2O_3$ layer has a thickness of from about 3 to about 12 μm and is the outermost layer with an XRD-diffraction intensity ratio I(012)/I(024) is greater than or equal to about 1.3 and with a mean Ra value MRa less than or equal to about 0.12 μm at least in the chip contact zone on the rake face, as measured on ten randomly selected areas 10×10 $\mu m^2$ by AFM-technique and on said clearance face;

the $TiC_xN_y$ layer has a tensile stress in the range from about 500 to about 700 MPa;

the α-$Al_2O_3$ layer has an XRD-diffraction intensity ratio I(012)/I(024) less than about 1.5;

or on said at least one rake face and said at least one clearance side;

the $TiC_xN_y$ layer has a thickness of from about 5 to about 15 μm and a tensile stress level of from about 50 to about 390 MPa;

the α-$Al_2O_3$ layer has a thickness of from about 3 to about 12 μm, an XRD-diffraction intensity ratio I(012)/I(024) greater than or equal to about 1.3, and on the rake face is the outermost layer with a mean Ra value MRa less than or equal to about 0.12 μm at least in the chip contact zone on the rake face, as measured on ten randomly selected areas 10×10 $\mu m^2$ by AFM-technique and on that said clearance face the top layer comprises a colored heat resistant paint or a colored PVD layer.

2. A cutting tool insert of claim 1 wherein a thin, from about 0.2 to about 2 μm, $TiC_xN_yO_z$ bonding layer, x≧0, z>0 and y≧0, is between the $TiC_xN_y$ and the $Al_2O_3$ layer.

3. A cutting tool insert of claim 1 wherein the α-$Al_2O_3$ layer having a texture in the 012-direction with a texture coefficient TC(012) is greater than about 1.3.

4. A cutting tool insert of claim 3 wherein the texture coefficient TC(012) is greater than about 1.5.

5. A cutting tool insert of claim 1 wherein the α-$Al_2O_3$ layer having a texture in the 110-direction with a texture coefficient TC(110) is greater than about 1.5.

6. A cutting tool insert of claim 1 wherein the coating contains additional layers composed of metal nitrides and/or carbides and/or oxides with the metal elements selected from Ti, Nb, Hf, V, Ta, Mo, Zr, Cr, W and Al to a total layer thickness of less than about 5 μm.

7. A cutting tool insert of claim 1 wherein said insert has a composition of from about 9.3 to about 10.7 wt-% Co, a CW-ratio in the range of from about 0.78 to about 0.88, a surface zone of a thickness of from about 15 to about 25 μm, and said $TiC_xN_y$ layer being deposited by MTCVD.

8. A cutting tool insert of claim 7 wherein said insert has a composition of from about 9.3 to about 10.4 wt-% Co.

9. A cutting tool insert of claim 1 wherein said α-$Al_2O_3$ layer has a thickness of from about 3.5 to about 8 μm and an XRD-diffraction intensity ratio I(012)/I(024) greater than or equal to about 1.5 with a mean Ra value MRa equal to or less than about 0.10 μm.

10. A cutting tool insert of claim 1 wherein on said clearance face, the $Al_2O_3$ layer is covered with a thin, from about 0.1 to about 2 μm, TiN, $TiC_xN_y$, $ZrC_xN_y$, or TiC layer giving the insert a different color on that face.

11. A cutting tool insert of claim 1 wherein on said at least one rake face and said at least one clearance side, the $TiC_xN_y$ layer has a thickness of from about 6 to about 13 μm, and a tensile stress level of from about 50 to about 300 MPa, the $Al_2O_3$ layer has a thickness of from about 3.5 to about 8 μm, an XRD-diffraction intensity ratio I(012)/I(024) greater than or equal to 1.5 and on the rake face is the outermost layer with a mean Ra value MRa less than or equal to about 10 μm.

12. A cutting tool insert of claim 11 wherein the $TiC_xN_y$ layer has a thickness of from about 7 to about 13 μm.

13. A cutting tool insert of claim 12 wherein the $TiC_xN_y$ layer has a thickness of from about 9 to about 13 μm.

14. A cutting tool insert of claim 1 wherein the $Al_2O_3$ layer has a thickness of from about 7 to about 12 μm.

* * * * *